United States Patent [19]

Fujimori

[11] 3,950,937

[45] Apr. 20, 1976

[54] STRUCTURE OF WATER-TIGHT WATCH CASE

[75] Inventor: Yoshiaki Fujimori, Suwa, Japan

[73] Assignee: Kabushiki Kaisha Suwa Seikosha, Tokyo, Japan

[22] Filed: Dec. 26, 1974

[21] Appl. No.: 536,523

[30] Foreign Application Priority Data

Dec. 25, 1973 Japan ..... 49-5284

[52] U.S. Cl. ..... 58/90 R

[51] Int. Cl.[2] ..... G04B 37/08

[58] Field of Search ..... 58/90 R, 91, 53

[56] References Cited

UNITED STATES PATENTS 3,858,388 1/1975 Fujimori ..... 58/90 R

*Primary Examiner*—George H. Miller, Jr.

*Attorney, Agent, or Firm*—Blum, Moscovitz, Friedman & Kaplan

[57] ABSTRACT

A water-tight watch case construction is provided which includes a case body, a crystal mounted in one end of the case body, and a back cover connected to the other end thereof. The crystal is provided with a beveled top edge and a vertical surface between the top and under surfaces thereof. The portion of the case body adjacent the vertical surface of the crystal is recessed for thereby defining a gasket seat and a peripheral flange overlying the beveled edge of the crystal. A gasket is mounted in the gasket seat and the vertical edge of the crystal is compressively engaged therewith. Underlying the crystal is a supporting flange releasably mounted in the case body for supporting the crystal along a marginal portion of the underside surface thereof. Releasably securing the supporting flange in position is a supporting frame connected to the dial assembly of the watch which is provided with an elbow abutting a relief provided on the back cover of the watch. The case body and back cover of the watch are respectively provided with corresponding threads and the back cover is threadably connected to the case body for thereby engaging the relief provided in the back cover against the supporting frame for the crystal support flange.

6 Claims, 2 Drawing Figures

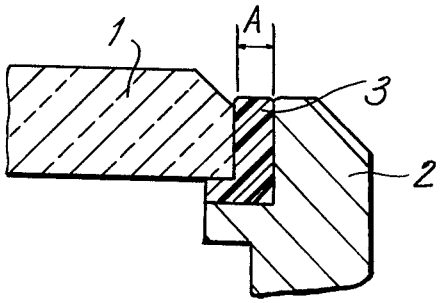
PRIOR ART
FIG. 1
FIG. 2
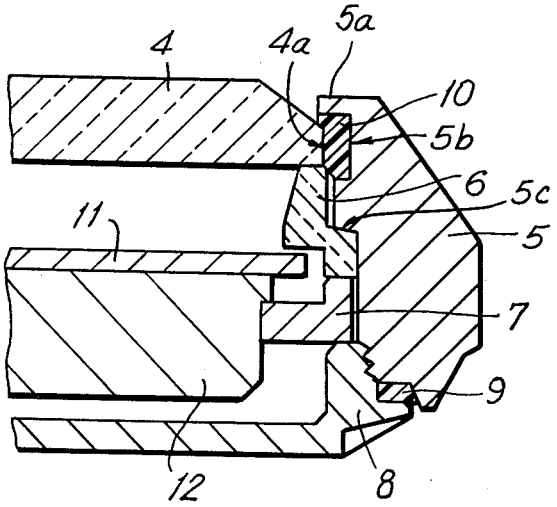

STRUCTURE OF WATER-TIGHT WATCH CASE

BACKGROUND OF THE INVENTION

The present invention relates to a watch case construction, and more particularly to a novel construction for a water-tight watch case.

Conventional water-tight watch cases include a bezel, a crystal and a gasket compressively mounted between the crystal and bezel and which is visible along the perimeter of the watch case. Use of a bezel member in these prior watch cases increases the bulk thereof and provides for a cumbersome appearance. Moreover, the aesthetic appearance of these prior cases is diminished because the gasket which provides the water-tight seal between crystal and bezel is readily visible to the naked eye.

Accordingly, the watch case construction within the scope of the instant invention is water-tight, compact and has a highly aesthetic appearance.

SUMMARY OF THE INVENTION

Generally speaking, in accordance with the invention, a water-tight watch case construction is provided which includes a case body, a crystal mounted in one end of the case body, and a back cover connected to the other end thereof. The crystal is provided with a beveled top edge and a vertical surface between the top and under surfaces thereof. The portion of the case body adjacent the vertical surface of the crystal is recessed for thereby defining a gasket seat and a peripheral flange overlying the beveled edge of the crystal. A gasket is mounted in the gasket seat and the vertical edge of the crystal is compressively engaged therewith.

Underlying the crystal is a supporting flange releasably mounted in the case body for supporting the crystal along a marginal portion of the underside surface thereof. Releasably securing the supporting flange in position is a supporting frame connected to the dial assembly of the watch which is provided with an elbow abutting a relief provided on the back cover of the watch. The case body and back cover of the watch are respectively provided with corresponding threads and the back cover is threadably connected to the case body for thereby engaging the relief provided in the back cover against the supporting frame for the crystal support flange.

Accordingly, it is an object of this invention to provide a novel watch case.

Another object of this invention is to provide a novel watch case which is water-tight.

Still another object of the invention is to provide a water-tight watch case which is compact and has a highly aesthetic appearance.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWING

For a fuller understanding of the invention, reference is had to the following description taken in connection with the accompanying drawing, in which:

FIG. 1 is a fragmentary sectional view showing the conventional arrangement of a crystal, case body and gasket of the type employed in prior watch cases; and FIG. 2 is a fragmentary sectional view of a water-tight watch case constructed in accordance with the instant invention.

DESCRIPTION OF PREFERRED EMBODIMENT

Referring now to FIG. 1, a crystal, gasket, and case body arrangement of the type employed in conventional watch cases is shown. A case body 2 is provided with a stepped in recess along the upper perimeter thereof and a gasket of water-tight ring 3 fabricated, for instance, of a synthetic resin is seated therein. A crystal 1 overlying a shoulder of gasket 3 abuts the continuous collar thereof along its substantially vertical edge. Crystal 1 diametrally compresses gasket 3 toward case body 2 for thereby providing a water-tight seal between crystal 1 and case body 2. While gasket 3 is fabricated of a relatively hard material, it is characterized by a predetermined elasticity. According to this prior construction, the collar portion of gasket 3 has a thickness A which must be maintained for providing a water-tight seal and which may not be exceeded so as to crack, break or split the gasket. To provide the appropriate water-tight seal, it has been found necessary that the collar portion of gasket 3 be substantially coextensive in length with the vertical edge of crystal 1. Therefore, gasket 3 is visible to the naked eye of an observer. This factor detracts from the appearance of the watch case.

Another drawback of this construction is that fixed placement of crystal 1 depends upon the characteristics of gasket 3. Therefore, if an environmental condition affects the rigidity, elasticity or resilience of gasket 3, then crystal 1 may inadvertently release from its mounting. Consequently, this type mounting arrangement is not entirely reliable for securing crystal 1 in place.

Accordingly, the instant invention provides a construction which overcomes the disadvantages of the prior conventional constructions. Simultaneously, this novel construction has a highly satisfactory appearance and demonstrates optimum water-tightness. In the instant construction, the crystal is mounted in the case body through the underside thereof, rather than merely overlying the case body. In other words, the crystal is mounted through the watch case aperture over which the back cover of the watch is releasably connected.

Referring now to FIG. 2, a water-tight watch case is seen having a case body 5, crystal 4 and a back cover 8. Case body 5 is provided with a recess **5*b* in which a gasket 10 sits. Overlying the recess is a lateral lip 5*a* which overhangs the beveled edge of crystal 4. Crystal 4 is mounted in the case body through the aperture therein ordinarily overfitted by back cover 8. To secure crystal 4 in position it is urged upwardly through the case body until vertical edge 4*a* thereof compressively abuts gasket 10.**

Lateral lip **5*a* secures crystal 4 in case body 5 against an excess upward pressure thereon. Supporting crystal 4 against a downward sliding pressure is a supporting flange 6 which is releasably mounted in case body 5. A recess 5*c* is provided in case body 5 for a shoulder of supporting flange 6. To mount supporting flange 6 in the case body, it is inserted upwardly through the back cover aperture until the shoulder thereof abuts the side walls of recess 5*c*, and simultaneous therewith the supporting collar of flange 6 engages crystal 4 along the margin of the underside surface thereof for thereby urging crystal 4 upwardly and into compressive abutment with gasket 10.**

Underlying support flange 6 is a support frame 7 for maintaining support flange 6 in upward juxtaposition. Support frame 7 is inserted into case body 5 through the back cover aperture and engages flange 6 for maintaining the shoulder thereof in abutment with side walls of recess 5*c*.

Proximate the aperture overfitted by back cover 8, case body 5 is provided with a continuous threaded portion. Back cover 8 is provided with a corresponding continuous thread and threadably connecting into case body 5 to thereby overfit the back cover aperture therein. Adjacent the threaded portion thereof, back cover 8 is provided with a relief shoulder abutting the elbow provided in support frame 7. Back cover 8 underlies support frame 7 and thereby provides an upward support therefor. Between the unthreaded interface of case body 5 and back cover 8 is a gasket 9 for providing a water-tight seal therebetween.

Within case body 5, the dial, movement and power source are removeably mounted. Dial 11 underlies respectively crystal 4 and an elbow provided support flange 6. The collar which upwardly extends on support flange 6 has an interior upwardly tapered interior surface for thereby providing that crystal 4 cannot slide downwardly and that dial 11 cannot slide upwardly into engagement. In other words, the relative respective positions thereof are maintained.

As is understood from the aforesaid description and as may be seen in FIG. 2, there is substantially certain placement of crystal 4. gasket 10 is diametrally compressed between vertical surface 4*a* of crystal 4 and case body 5. Additionally, crystal 4 is mechanically supported by back cover 8, frame 7 and flange 6. Overhanging the beveled edge of crystal 4 is lip 5*a* of case body 5 for limiting the upward movement of crystal 4 in its mounting. Since little or no upward movement of crystal 4 occurs, gasket 10 may be fabricated of softer than conventional material and the length thereof may be shorter than conventional lengths.

Since lip 5*a* overlies gasket 10, the gasket is not visible to the naked eye of an observer. Therefore, the appearance of the case is substantially improved in comparison with prior conventional cases. Cases within the scope of the instant invention are, moreover, easy to assemble or disassemble and access may be had to the movement or crystal with ease.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A watertight watch case comprising a case body, a crystal mounted in one end thereof, a back cover connectable to the other end thereof, said crystal having a substantially vertical surface between top and undersurfaces thereof, said case body having a recess therein substantially adjacent said vertical surface of said crystal, said recess comprising a gasket seat and defining a peripheral flange in said case body which overlies the periphery of said top crystal surface, a gasket mounted in said gasket seat in said case body, said vertical edge of said crystal being compressively engaged therewith, a supporting flange releasably mounted within said case body for supporting said crystal along a marginal portion of said underside surface thereof, a frame releasably mounted within said case body, said frame underlying and supporting said flange for securing said flange position, and means in said back cover for supporting said frame.

2. The watch case as claimed in claim 1 wherein said case body and said back cover therefor are respectively provided with corresponding threaded portions so as to threadably connect said back cover into said case body whereby said means in said back cover engage against said frame.

3. The watch case as claimed in claim 2 wherein said supporting flange includes a downturned base member, an upturned collar and a shoulder connecting said base member and said collar, said case body including an interior recessed portion in said side wall thereof a predetermined distance below said gasket seat, said predetermined distance corresponding with the length of said collar, said shoulder abutting said case body in said recessed portion thereof.

4. The watch case as claimed in claim 3 wherein said frame comprises a laterally extending base member and an upturned collar portion depending therefrom, said collar terminating in an abutment surface which abuts and supports said supporting flange, said lateral base member and said collar being joined at an elbow.

5. The watch case as claimed in claim 4 wherein said case body includes a continuous interior relief, said relief abutting said elbow of said frame for thereby supporting said frame within said case body.

6. The watch case as claimed in claim 5 including a gasket compressively mounted between unthreaded portions of the interface between said case body and said back cover.

* * * * *